US005611581A

United States Patent [19]

Ghostley

[11] Patent Number: 5,611,581

[45] Date of Patent: Mar. 18, 1997

[54] LATCH ASSEMBLY

[75] Inventor: Thomas J. Ghostley, Anaheim, Calif.

[73] Assignee: Emhart Inc., Newark, Del.

[21] Appl. No.: 402,671

[22] Filed: Mar. 13, 1995

[51] Int. Cl.[6] ..... E05C 1/12

[52] U.S. Cl. ..... 292/165; 292/169; 292/337; 292/169.13; 292/244

[58] Field of Search ..... 292/1.5, 165, 167, 292/169, 169.13, 169.17, 169.18, 169.19; 70/224, 461

[56] References Cited

U.S. PATENT DOCUMENTS

| | | | |
|---|---|---|---|
| 4,031,725 | 6/1977 | Reid | 292/169.13 X |
| 4,516,798 | 5/1985 | Bergen | 292/169.13 |
| 4,593,542 | 6/1986 | Rotondi et al. | 70/461 X |
| 4,664,433 | 5/1987 | Solovieff | 292/337 |
| 4,729,585 | 3/1988 | Lin | 292/169.13 X |
| 4,746,154 | 5/1988 | Fang | 292/169 X |
| 4,844,522 | 7/1989 | Pechar | 292/169 |
| 5,149,151 | 9/1992 | Shen | 292/1.5 |
| 5,364,138 | 11/1994 | Dietrich et al. | 292/165 X |
| 5,452,928 | 9/1995 | Donald | 292/169.13 X |

*Primary Examiner*—Rodney M. Lindsey
*Assistant Examiner*—Monica E. Millner
*Attorney, Agent, or Firm*—Spencer T. Smith

[57] ABSTRACT

A latch assembly wherein a retractor member conjointly lowers a stop which is preventing latch bolt retraction and rotates a cam which will retract the bolt. A deadlatch bolt stop, which limits the forward displacement of the deadlatch bolt relative to the latch bolt, can be brought into engagement with the latch bolt since it can deflect the stop, which is preventing latch bolt retraction, down out of its way.

4 Claims, 5 Drawing Sheets

12
14
32
21
58
30
20
38
36
56
46
44
41
48
42
60
18
26
16
92
96
54
45
23
17
94
40
52
22
10
94
25
100
84
24
106
82
80
88
98
98
106
92
102
90
104
86
78

LATCH ASSEMBLY

In conventional deadlatch assemblies, turning the operator rotates a half round spindle clockwise or counterclockwise to alternately engage the legs of a retractor member to advance it to operate a linkage which will control the displacement of the latch bolt head and the deadlatch bolt. U.S. Pat. Nos. 4,427,224, 4,516,798, 4,664,433 and 4,844,522 disclose conventional structures.

It is an object of the present invention to provide a latch mechanism which has a very compact linkage arrangement for controlling the displacement of the latch bolt head and the deadlatch bolt.

Other objects and advantages of the present invention will become apparent from the following portion of this specification and from the accompanying drawings which illustrate in accordance with the mandate of the patent statutes a presently preferred embodiment incorporating the principles of the invention.

Referring to the drawings.

Figure 1:
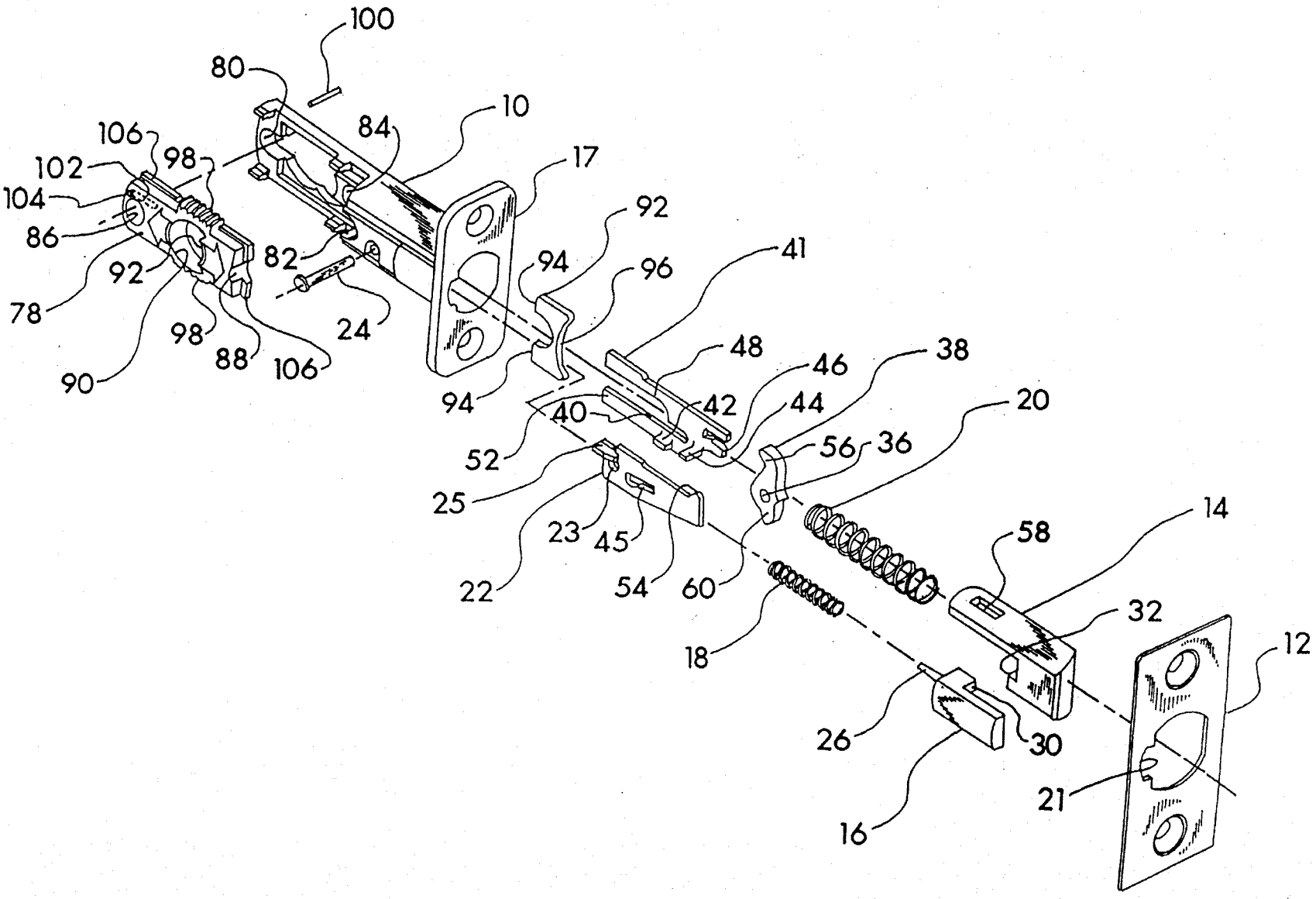
FIG. 1 is an oblique exploded view of the components of the adjustable latch made in accordance with the teachings of the present invention.

The components of the adjustable latch are shown in FIG. 1. The latch-bolt case 10, which has a backing plate 17, is suitably secured within a bore in a door and is dressed with a front face plate 12. A latch-bolt head 14 and a deadlatch bolt 16 are biased outwardly by associated first 18 and second 20 springs. When a door is closed the latch-bolt head 14 extends beyond the front face plate 12 and through a hole in the strike plate (not shown) and into a hole in the door jam (not shown) and the deadlatch bolt 16 (which can move relative to the latch-bolt head 14) extends beyond the face plate into a final position against the strike plate.

The adjustable latch also has a latch dog 22 which has a hole 23 for receiving a rivet 24 which is supported by the latch-bolt case. The latch dog 22 accordingly is pivotal about the rivet. The first spring 18 is compressively located on axially projecting pins 25, 26 on the latch dog and deadlatch bolt. The compressed first spring accordingly pushes the deadlatch bolt 16 forwardly until either the front of it strikes the strike plate or an inwardly projecting stop portion 30 abuts against a stop surface 32 on the latch-bolt head. The rivet also extends through a hole 36 in a latch cam 38 and through an axial slot 40 in the retracting member 41. Projecting sidewardly from the retracting member are a cam actuator 42 which engages the bottom of the latch cam 38 and a deadlock release finger 44 which is received by a deadlock release slot 45 in the latch dog 22. The top axially extending runner 48 of the retracting member slides within a suitable slot in the latch-bolt head. The second spring is compressively located between a spring receiving post 46 on the retracting member and a circular hole in the latch-bolt head and urges the retracting member rearwardly to its neutral position against the rivet.

In the fully extended position (FIG. 2) (the door is open) for the 2⅜" backset, the opposing sides of the half round spindle 50 of a latch driving spindle (not shown) engage the rear ends of the upper runner 48 and a lower leg 52 of the retracting member which is at its furthest inward position. With the retracting member at this position, the release finger 44 is at the rearward end of the release finger slot 45 and the latch dog 22 is pivoted to a position where its upwardly projecting end portion 54 engages the bottom surface 55 of the stop portion 30 of the deadlatch bolt 16. The upper end 56 of the latch cam 38 is received by a latch cam slot 58 in the latch-bolt head and the second spring 20 pushes the latch-bolt outwardly until the latch cam is rotated clockwise to the orientation where the upper end 56 engages the rear end of the latch cam slot 58 and the lower end 60 of the latch cam engages the cam actuator 42. The deadlatch bolt is pushed forward by spring 18 until it engages and is stopped by the latch-bolt head.

Figure 3:
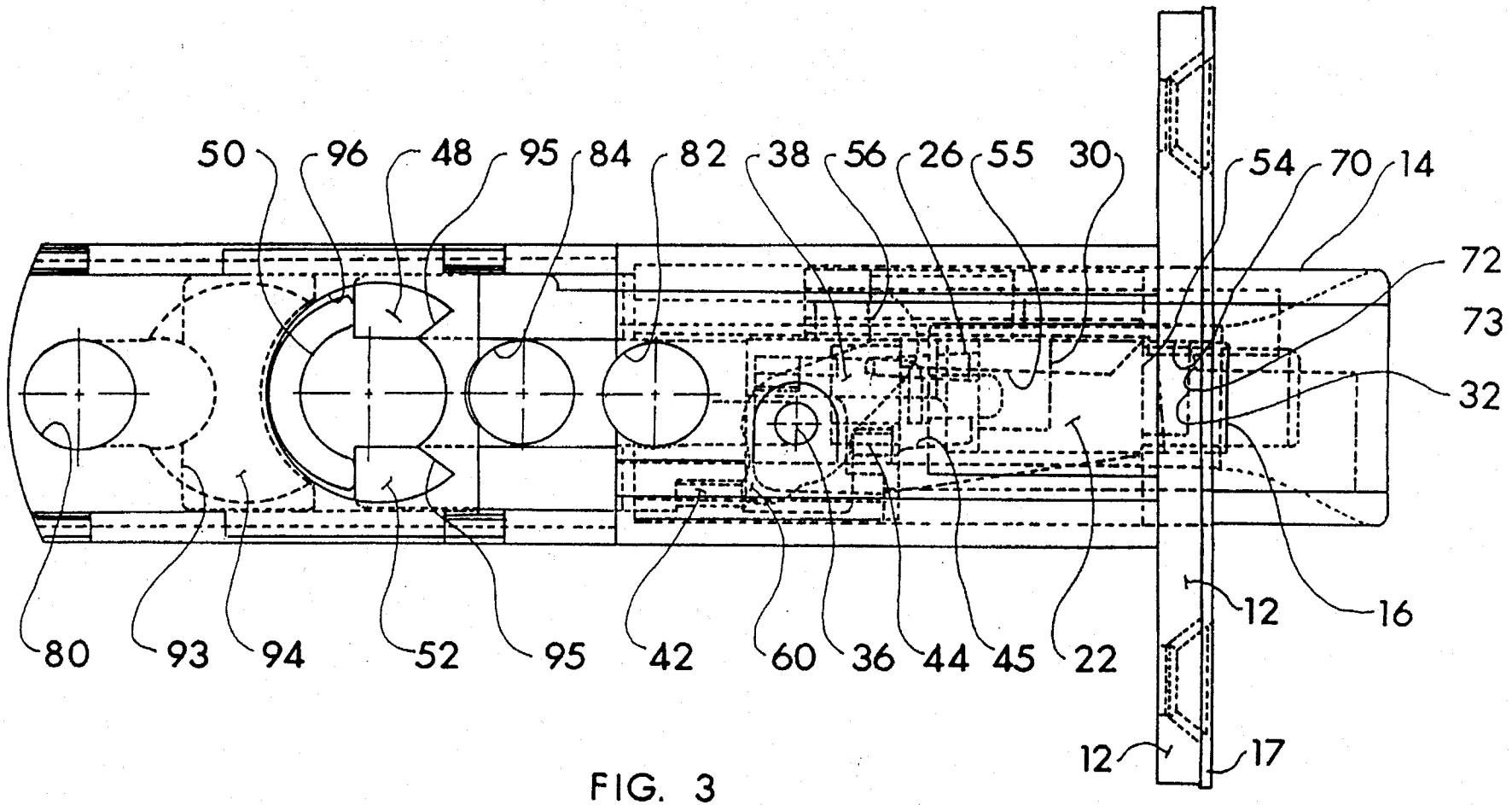
FIG. 3 is a view similar to that of FIG. 2 showing a portion of the latch assembly in the deadlocked position.

When the door is closed, the latch-bolt enters a hole in the door jam and the deadlatch bolt engages the strike plate. FIG. 3 illustrates the adjustable latch at this deadlocked position. When the deadlatch bolt engages the strike plate, its forward movement stops. It is accordingly axially shifted relative to the latch-bolt head (and the latch dog) so that the end stop portion 54 of the latch dog clears the bottom surface 55 of the stop portion 30 so that the first spring 18 can rotate the latch dog counterclockwise into a slot 70 in the latch-bolt head. The forward end of this slot is defined by a stop surface 72 on stop 73. In the event someone tries to move the latch-bolt head rearwardly, this stop surface 72 will hit the upwardly extending stop portion 54 of the latch dog to prevent further displacement.

Figure 4:
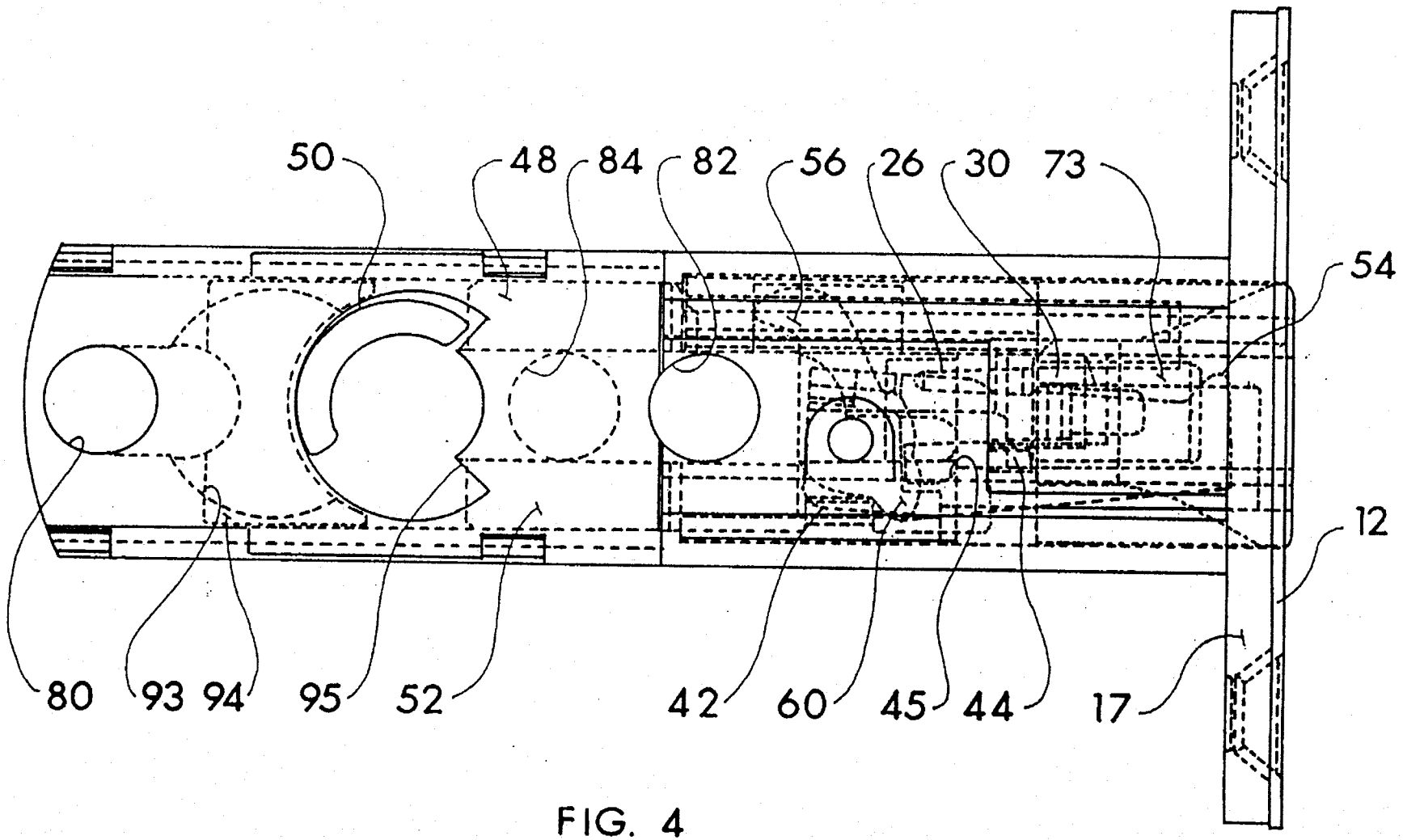
FIG. 4 is a view similar to that of FIG. 2 showing the latch assembly in the open position.

When the door is opened, the spindle is rotated to rotate the half round 50 to one of its two fully opened positions shown in FIG. 4. Movement of the retracting member forwardly results in the deadlock release finger 44 engaging the inclined ramp portion 75 of the bottom surface of the release finger slot 45 thereby pivoting the latch dog clockwise to retract the stop portion 54 of the latch dog out of the way of the stop surface 72 and to its lowest position below the stop 73. Simultaneously, the cam actuator 42 will engage and rotate the latch cam counterclockwise so that the upper end 56 of the latch cam 38 will engage the rear end of the latch-bolt head slot 58 to retract the latch-bolt head. The latch-bolt head 14 and the deadlatch bolt will be then located as shown in FIG. 4 at the bolt retracted position.

Figure 2:
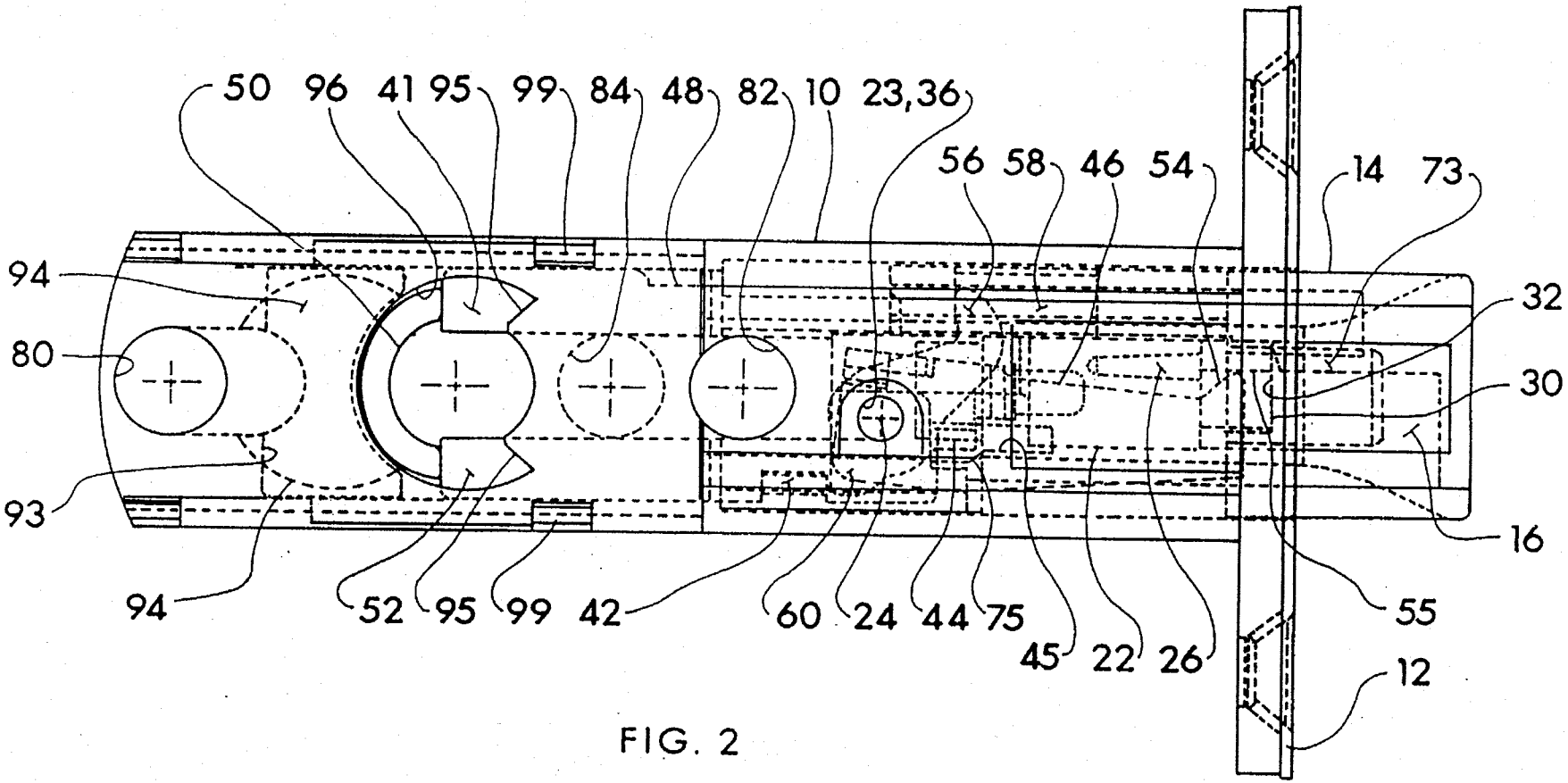
FIG. 2 is a side elevational cross-sectional view of the latch assembly in the extended position.

FIGS. 2–4 illustrate the latch with a 2⅜" backset. The latch casing 10 has three thru holes; One 80 at the rearwardmost end, a second 82 which is spaced from the first hole so that they can receive the stems of the lock assembly and a third hole 84 spaced ⅜" rearwardly from the forwardmost hole 82. The plastic cover 78 shown in FIG. 1 has a hole 86 at the rearward end which overlies hole 80 and a circular cutout 88 which allows hole 82 to be fully exposed when the latch is set for a 2⅜" backset. In the center of the cover is a center hole 90 that receives the half round and a pair of stop surfaces 95 for limiting its rotation in either direction.

Figure 5:
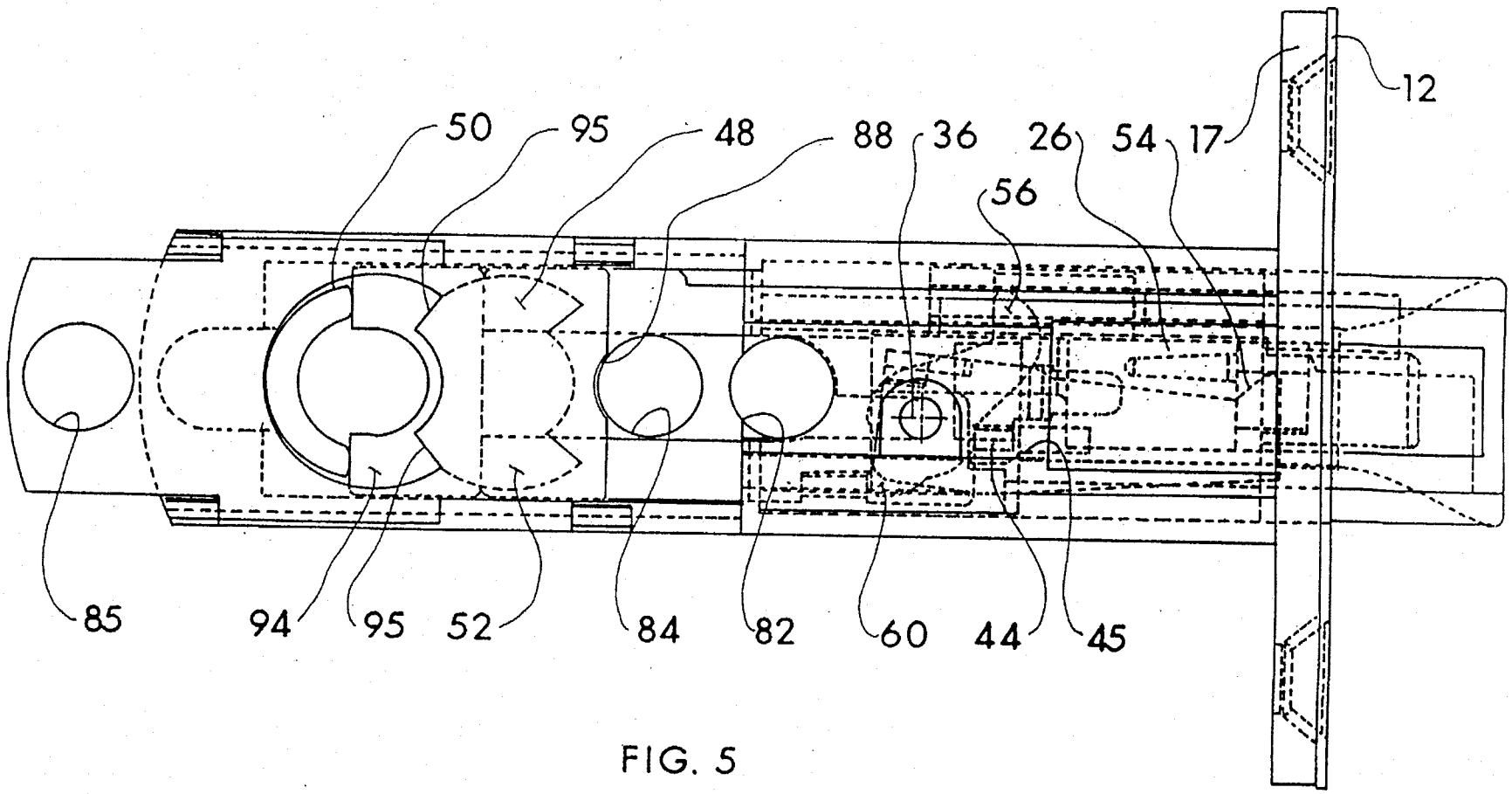
FIG. 5 is a view similar to that of FIG. 2 showing the latch assembly adjusted to 2¾" backset.

To adjust the latch assembly to a 2¾" backset, the cover is shifted rearwardly to its other extreme position (FIG. 5). The middle casing hole 84 has now been exposed (the cover has a circular cutout 88 to completely expose casing hole 84) and since the casing has shifted a distance which equals ⅜", the hole 86 in the cover along with middle casing hole 84 become the stem receiving holes. The spacer bracket converter 92, which is ⅜" wide is moved forwardly from its position shown in FIG. 2 to its position shown in FIG. 5 and the half round now engages this converter, which then moves the retracting member. The backset converter, which is displaceable between the retracting element and the rear wall 93 of a casing pocket, has a pair of rearwardly extending legs 94 which will engage the sides of the half round with a 2¾ backset and a circular surface 96 at the front for engaging the rear surface of the half round with a 2⅜"

backset. The ⅜" shift is accurately controlled. Shifting of the plastic cover to the right to its furthest right (2⅜" backset position) is controlled by the engagement of the upwardly and downwardly projecting roughed portions 98 of the plastic guard with housing stops 99. A push pin 100, which is pushed into a receiving hole in the housing 10 is keyed within an elongated groove 102 on the interior wall of the cover. The elongated groove ends to locate the backset at 2¾". A thru hole 104 is defined at the other end of the elongated groove to permit insertion and removal of the push pin. The plastic cover also has top and bottom runners 106 which are captured within suitable grooves in the housing stops, not shown for clarity.

I claim:

1. A latch assembly comprising:

a latch bolt head including an axially extending internal bore supporting a stop and an axially extending slot with a rear end, a deadlatch bolt including a stop having front and bottom surfaces, a casing for supporting said latch bolt head for axial displacement between dead,bolt and retracted positions and for supporting said deadlatch bolt for axial displacement, relative to said latch bolt head, from a forward position, whereat said deadlatch bolt stop front surface engages said latch bolt head stop, to a rearward position, a transversely extending pivot post secured to said casing, a latch dog pivotally supported at one end by said pivot post and having a stop portion at the other end, a latch cam pivotally, centrally supported by said pivot post and including an upper portion on one side of said pivot post received by and engaging the rear end of said axially extending slot, and a lower portion, and a retracting member axially displaceable between retracted and advanced positions and including a transversely extending cam actuator for engaging said lower cam portion so that forward movement of said retracting member will result in said cam actuator pivoting said latch cam counterclockwise to retract said latch bolt head from said deadbolt position to said retracted position, and a transversely extending release finger, said latch dog including a release finger slot for receiving said release finger, said release finger slot being selectively configured so that said latch dog can rotate upwardly from a first position whereat said latch dog stop portion engages said deadlatch bolt stop bottom surface when said deadlatch bolt is at said forward position to a second higher position when said deadlatch bolt is at said rearward position whereat rearward displacement of said latch bolt head will bring said latch bolt head stop into engagement with said latch dog stop portion, and as said retracting member is displaced from said retracted position to said advanced position, when said deadlatch bolt is at said rearward position, said latch dog will be pivoted downwardly from said higher position to a position permitting the displacement of said latch bolt from said deadbolt position to said retracted position.

2. A latch assembly according to claim 1, further comprising first spring means for urging said latch bolt head towards said deadbolt position and second spring means for urging said deadlatch bolt towards said forward position.

3. A latch assembly according to claim 2, wherein said retracting member includes an axially extending slot for receiving said pivot post.

4. A latch assembly according to claim 3, wherein said pivot post is a rivet.

* * * * *